US007393240B2

(12) United States Patent
Nishimatsu et al.

(10) Patent No.: US 7,393,240 B2
(45) Date of Patent: Jul. 1, 2008

(54) ELECTRICAL CONNECTOR

(75) Inventors: Norimasa Nishimatsu, Tokyo (JP); Fuminobu Tamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/808,995

(22) Filed: Jun. 14, 2007

(65) Prior Publication Data

US 2007/0298643 A1 Dec. 27, 2007

(30) Foreign Application Priority Data

Jun. 22, 2006 (JP) ..... 2006-172070

(51) Int. Cl.
*H01R 12/24* (2006.01)

(52) U.S. Cl. ..... 439/495

(58) Field of Classification Search ..... 439/495, 439/260, 261, 267

See application file for complete search history.

(56) References Cited

U.S. PATENT DOCUMENTS

| | | | | |
|---|---|---|---|---|
| 6,099,346 | A * | 8/2000 | Hashiguchi et al. | 439/495 |
| 6,116,947 | A * | 9/2000 | Takayasu | 439/495 |
| 6,431,897 | B1 * | 8/2002 | Hashiguchi et al. | 439/267 |
| 6,755,682 | B2 * | 6/2004 | Kunishi et al. | 439/495 |
| 7,189,104 | B1 * | 3/2007 | Gillespie et al. | 439/495 |
| 2002/0106924 | A1 * | 8/2002 | Uehara | 439/260 |
| 2002/0115340 | A1 * | 8/2002 | Yamane | 439/495 |
| 2003/0060072 | A1 * | 3/2003 | Miura | 439/260 |
| 2003/0211773 | A1 * | 11/2003 | Ishii | 439/495 |
| 2005/0106931 | A1 * | 5/2005 | Yagi et al. | 439/495 |
| 2006/0105621 | A1 * | 5/2006 | Zhang et al. | 439/495 |
| 2006/0110950 | A1 * | 5/2006 | Ikenaga et al. | 439/67 |
| 2007/0105423 | A1 * | 5/2007 | Gillespie et al. | 439/260 |

FOREIGN PATENT DOCUMENTS

| | | | |
|---|---|---|---|
| EP | 340994 | A1 * | 11/1989 |
| JP | 2001-35612 | | 2/2001 |

* cited by examiner

*Primary Examiner*—Tulsidas C. Patel
*Assistant Examiner*—Vladimir Imas
(74) *Attorney, Agent, or Firm*—Kubotera & Associates, LLC

(57) ABSTRACT

An electrical connector is to be arranged on a circuit board. The electrical connector includes a housing made of an insulating material and a holding section disposed in the housing. The holding section has an open area opening upward. The electrical connector further includes a terminal arranged in the holding section. The terminal includes a connecting section exposed outside the housing for connecting to the circuit board. The electrical connector further includes a sheet member situated over the holding section for covering at least a part of the open area.

8 Claims, 6 Drawing Sheets

ELECTRICAL CONNECTOR

BACKGROUND OF THE INVENTION

1. Field of the Invention

The present invention relates to an electrical connector, especially an electrical connector to be arranged on a circuit board.

2. Description of Related Art

Japanese Patent Publication No. 2001-035612 has disclosed a connector of this type. In Japanese Patent Publication No. 2001-035612, the connector is disposed on a circuit board, and has a flat shape extending in parallel to the circuit board as a whole. The connector has a terminal receiving groove opening in a lateral direction (i.e. font-and rear direction) between an upper wall and a lower wall of a housing for receiving the terminal. A contact section of the terminal is positioned at a front opening of the housing, and contacts with a flat cable or the like to be inserted into the front opening from a front side. The contact is maintained with a slider inserted to the front opening. A connecting section of the terminal protrudes backward outside of the housing, and is connected to a corresponding circuit unit on the circuit board with solder. Furthermore, the connector has a cover member made of a sheet metal contacting through a surface thereof with an upper surface of the upper wall of the housing.

In the connector described above, a low profile design, i.e. small dimension in a height direction, is desired. The connector disclosed in Japanese Patent Publication No. 2001-035612 is not satisfactory with respect to the low profile design, and still needs improvement. In the connector disclosed in Japanese Patent Publication No. 2001-035612, a height of the connector depends on the housing. Accordingly, the height of the housing has to be reduced in order to achieve a low profile connector. When thicknesses of the upper wall and the lower wall of the housing are reduced, the housing may be cracked at the time of molding a synthetic resin, thereby making it difficult to reduce the thicknesses as much as desired. Since the connector disclosed in Japanese Patent Publication No. 2001-035612 has a cover member made of a sheet metal on the upper surface of the upper wall of the housing, the height of the connector has to be increased for the thickness of the sheet metal.

In view of the problems described above, an object of the invention is to provide a connector, which enables to make a satisfactorily low profile connector without impairing the performances of the connector.

Further objects of the invention will be apparent from the following description of the invention.

SUMMARY OF THE INVENTION

In order to obtain the objects described above, according to an embodiment of the present invention, an electrical connector is arranged on a circuit board, and has a terminal arranged and held by a holding section of the housing made of an insulating material. A connecting section of the terminal is exposed outside the housing and can be connected to the above-described circuit board.

According to the embodiment of the invention, the electrical connector has an open area opening upward at least within an arrangement range of the terminal. A sheet member is arranged in the open area for covering at least a part of the open area.

The sheet member is made of a material rolled with pressure or stretched, and has a small thickness and sufficient flexibility. The sheet member is arranged in the open area to protect the terminal. Therefore, the sheet member is thinner and more flexible than an upper wall of a conventional housing made by a general molding process. As a result, as opposed to a conventional general molding process, it is possible to produce prevent the low profile connector without causing a crack. Since the sheet member has enough flexibility, the sheet member can deform when the terminal or the housing displaces, thereby generating little stress.

In the present invention, the sheet member may be formed of an insulating sheet. The insulating sheet is arranged contacting with the terminal, and does not cause short circuit between terminals or with other components.

In the present invention, the sheet member may be formed of a sheet metal, and the housing holds a signal terminal and a grounding member. The sheet metal can be arranged having a certain distance away from the signal terminal, and can be attached to the grounding member while contacting with the grounding member. In this case, the sheet metal covers the terminal in the open area of the housing to generate a shielding effect, and connects to ground via the grounding member. The signals terminal is arranged a certain distance away from the sheet metal, so that the sheet metal does not contact with the signal terminal. For example, the terminal may be embedded in the housing from the upper surface of the housing in the open area.

In the present invention, the sheet member may be formed of a composite sheet comprising an insulating layer and a metal layer. The insulating layer can be arranged facing the terminal. Accordingly, even when the sheet member is arranged contacting with the terminal, the insulating layer contacts with the terminal, so that the terminal does not short-circuit and the metal layer shields the terminal.

Alternatively, the composite sheet may be formed of insulating layers formed on both sides of a metal layer. With the configuration, the metal layer is not exposed to the upper face. Accordingly, the terminal does not contact with other components unexpectedly and the metal layer does not rust. The metal layer of the composite sheet can be a metal foil adhered on the insulating layer or the insulating layer plated with metal.

According to the present invention, the connector has a receiving section to receive one end of a flat conductor. At least at the terminal or the housing, a pressuring member is supported so as to freely rotatable between an open position and a closed position, so that the connector increases a contacting pressure of the flat conductor to the contact section of the terminal at the closed position. The holding section of the housing may be provided outside a rotational movement range of the pressuring member. Accordingly, the electrical connector is suitable for a low profile design to be arranged on a circuit board in an actual use.

In the present invention, the terminal may include a signal terminal and a ground terminal connected to ground. In this case, the sheet member covers the signal terminal and the ground terminal in the open area of the housing. When the sheet member is formed of a metal sheet or a composite sheet having a metal layer, the metal sheet or the metal layer contacts with the ground terminal and is connected to ground.

In the present invention, the ground member may be a reinforcing metal part attached to the housing. The reinforcing metal part reinforces the housing, and simultaneously contacts with a metal sheet or a metal sheet of a composite sheet as a ground member.

In the present invention, as described above, the housing supporting the terminal has no upper wall. Instead of the upper wall, the sheet member is provided. The sheet member has a thickness smaller than that of the upper wall. Accordingly, it is possible to reduce a height of the connector by a difference between the sheet member and the upper wall.

Further, it is possible to protect the terminal without the upper wall. The sheet member is capable of following displacement of the terminal. When the sheet member includes the metal layer, it is possible to provide shielding effect without increasing a thickness of the connector. In this case, as oppose to a conventional connector having a metal cover member, it is possible to further reduce a height of the connector.

BRIEF DESCRIPTION OF THE DRAWINGS

FIGS. 8(A) and 8(B) are views showing a connector in a state that a sheet member is connected to a reinforcing metal part according to another embodiment of the present invention, wherein FIG. 8(A) is a perspective view thereof, and FIG. 8(B) is a sectional view thereof near the reinforcing metal part.

DESCRIPTION OF THE PREFERRED EMBODIMENTS

Figure 1:
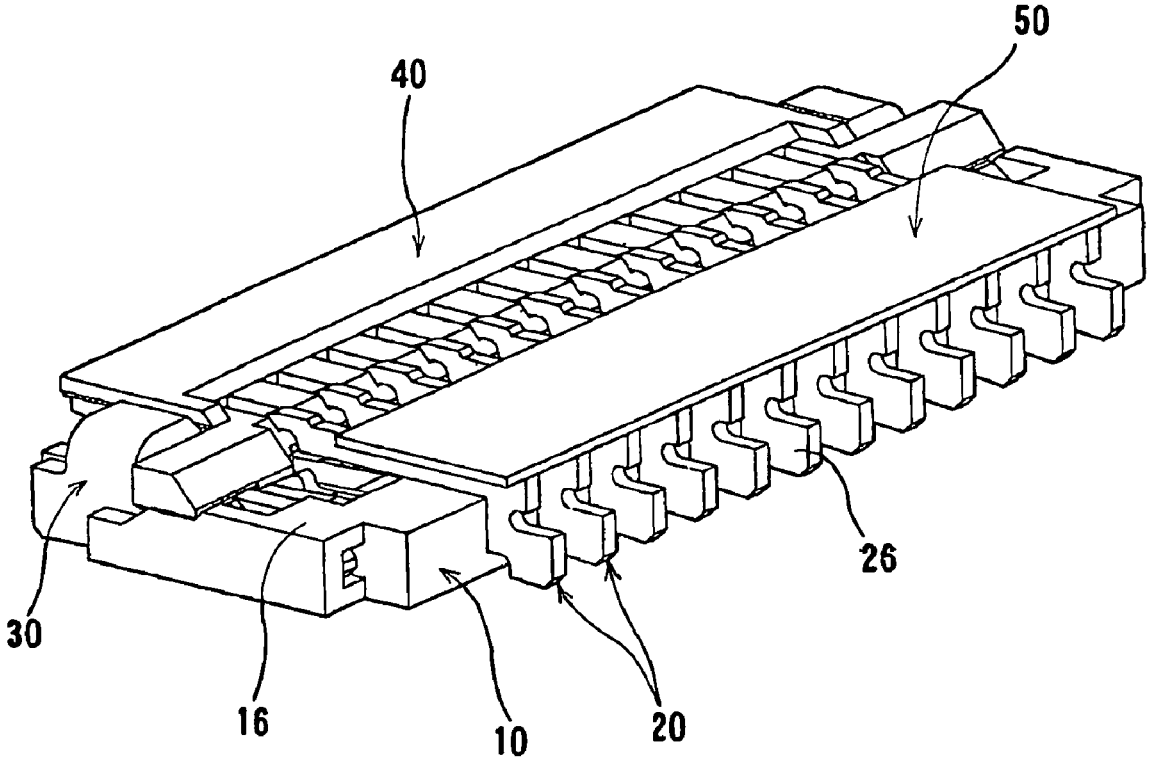
FIG. 1 is a perspective view showing a connector according to an embodiment of the invention.

Hereunder, embodiments of the present invention will be explained with reference to the accompanying drawings. As shown in FIG. 1, according to an embodiment of the invention, a connector has a flat shape, and comprises a housing 10 formed of an electrical insulating material; a plurality of terminals 20 made of a metal and held by the housing 10; reinforcing metal parts 30 attached to the housing 10; a pressuring member 40 made of an electrical insulating material and held by the housing 10 and the terminals 20 so as to be freely rotatable; and a sheet member 50.

Figure 2:
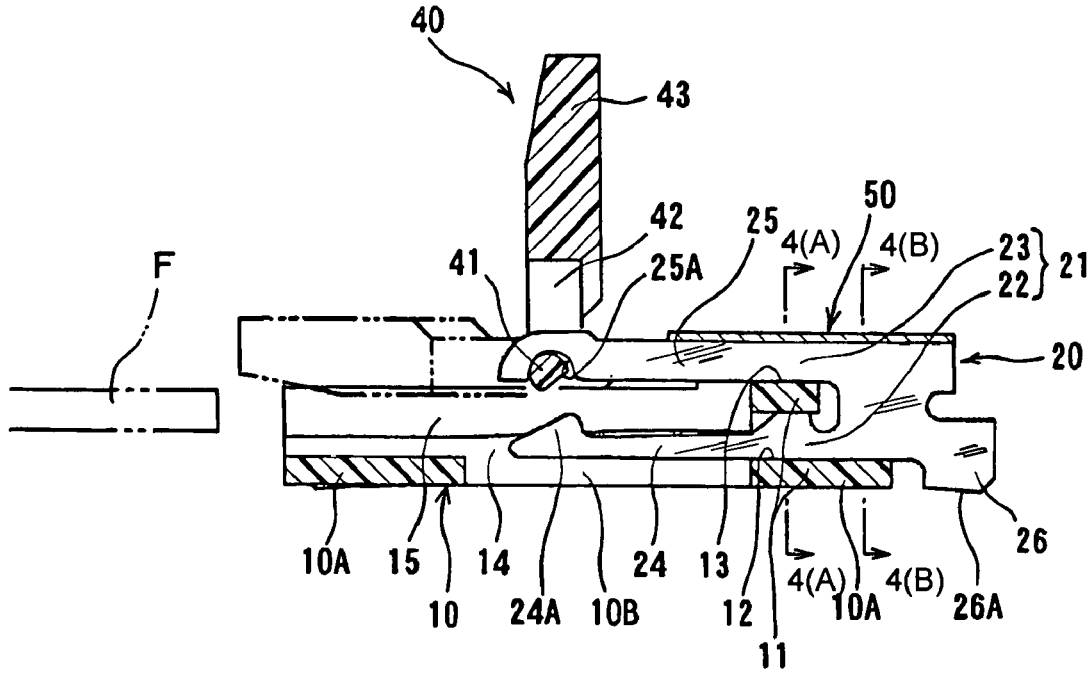
FIG. 2 is a sectional view of the connector shown in FIG. 1 taken along a plane between terminals.

As shown in FIG. 2, which shows a sectional view between two adjacent terminals 20, the housing 10 has a holding section 11 to hold the terminals 20 at a rear part thereof (right side in the figure). A contacting area is formed at a front part (left side in the figure) to receive a contact section of each terminal 20, and to receive and contact with a flat conductor F.

Figure 4:
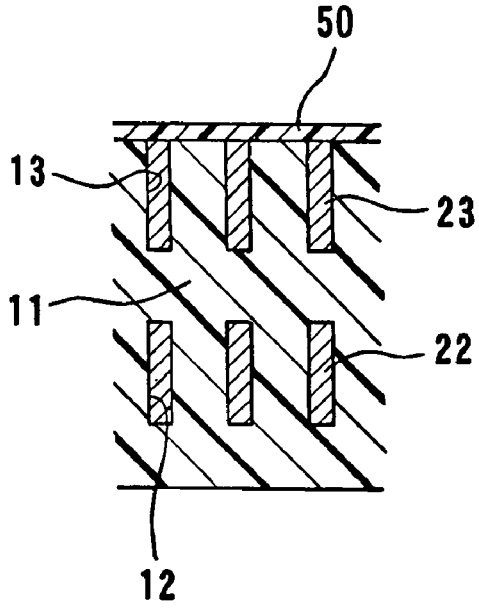
FIG. 4(A) is a sectional view of the connector taken along a line 4(A)-4(A) in FIG. 2.
FIG. 4(B) is a sectional view taken along a line 4(B)-4(B) in FIG. 2.
Figure 4:
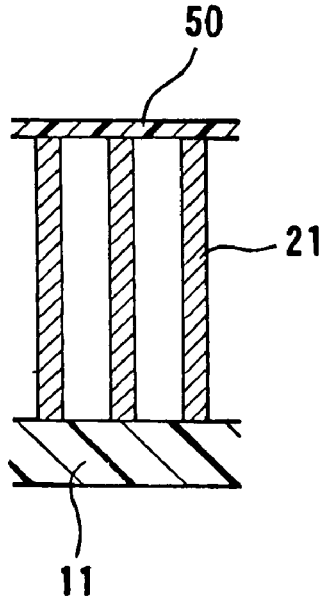

As shown in FIG. 4(A), which is a sectional view taken along a line 4(A)-4(A) in FIG. 2, the holding section 11 of the housing 10 has holding holes 12 and holding grooves 13. As described later, each terminal 20 is formed maintaining an original sheet metal surface. The holding holes 12 and the holding grooves 13 also have thicknesses equivalent to a thickness of the sheet metal.

In the embodiment, as shown in FIG. 1, a plurality of terminals 20 is arranged and held at the holding section 11. The holding grooves 13 open upward, so that the housing 10 has an open area in an arrangement range of the terminals 20. A bottom wall 10A of the housing 10, i.e., a bottom of each holding hole 12, extends backward. As shown in FIG. 4(B), which is a sectional view taken along a line 4(B)-4(B) in FIG. 2, the housing 10 does not have a part above the bottom wall 10A.

As shown in FIG. 2, the housing 10 has terminal housing grooves 14 at a lower portion of the contact area formed at the front part thereof before the holding section 11, and receiving sections 15 at an upper side of the contact area for receiving a flat conductor. The terminal housing grooves 14 extend in a front-and-back direction along an upper face of the bottom wall 10A of the housing 10, and open downward at an opening 10B of the bottom wall 10A at a middle portion in the front-and-back direction.

The receiving sections 15 are connected to each other in the arrangement direction of the terminals 20 (vertical direction to a sheet surface of FIG. 2) and open at the upper side of the contact area. The receiving sections 15 are spaces to receive the front edge of a flat conductor F. The housing 10 has wall edges 16 at both edges thereof in the arrangement direction (FIG. 1).

The reinforcing metal parts 30 are attached to outer surfaces of the wall edges 16. The reinforcing metal parts 30 reinforce the housing 10, and lower edges of the reinforcing metals 30 extend downward to a depth level same as that of the lower face of the housing 10. When the connector is mounted on a circuit board, the reinforcing metal parts 30 contact with a corresponding ground circuit formed on the circuit board. A shape of the terminals 20, the configuration of the housing 10 holding the terminals 20, and a shape of the reinforcing metal parts 30 are not limited to the embodiment, and may be same as those in a conventional connector.

As shown in FIG. 1, the terminals 20 are held with the housing 10 while maintaining the original flat surface of the sheet metal. As shown in FIG. 2, each of the terminals 20 has a held section 21 held by the housing 10. The held section 21 comprises a lower held section 22 and an upper held section 23. A lower arm 24 and an upper arm 25 extend frontward from the lower held section 22 and the upper held section 23, respectively. A front end of the upper arm 25 has a shaft supporting section 25A having a curved shape open downward. The lower arm 24 has elasticity in an up-and-down direction as an elastic arm, and has a protruding contact section 24A protruding upward at a front end thereof.

A rear end of the terminal 20 extends backward from the held section 21 and protrudes outside the housing 10. A lower end of the rear end forms a connecting section 26. A lower edge of the connecting section 26 contacts with a corresponding circuit on a circuit board through a surface thereof, and is connected thereto by soldering.

The held section 21 of the terminal 20 is pressed into the holding section 11 of the housing 10 from a rear side to a front side. The lower held sections 22 and the upper held sections 23 of the held sections 21 are pressed into the holding holes 12 and the holding grooves 13 of the housing 10, respectively. An upper edge of the upper held section 23 is positioned at a height level almost same as that of the upper face of the housing 10 that forms an edge of an opening of the holding grooves 13 of the housing 10.

The pressuring member 40 is arranged above the receiving sections 15 of the housing 10. As shown in FIG. 2, the pressuring section 40 has a shaft 41 at a lower end thereof, and is supported thereat. The pressuring member 40 pivotally rotates around the shaft 41 to a position indicated by a phantom line in FIG. 2. The pressuring member 40 may be supported with the housing 10 at end shafts thereof provided at sides of the pressuring member 40 in a extending direction of the shaft 41.

As shown in FIG. 2, the pressuring member 40 is situated at an open position, and the pressuring member 40 may be situated at a closed position indicated by the phantom line. The pressuring member 40 has a plurality of slit-like grooves 42 having a comb-like shape for inserting shaft-supporting sections 25A of the terminals 20. The shaft 41 is disposed in the grooves 42 to connect inner surfaces of the grooves 42. An upper part of the pressuring member 40 forms an operating section 43 to perform the pivotal movement.

When the connector is used, while the pressuring member 40 is situated at the open position, the flat conductor F is inserted into the receiving sections 15 of the connector arranged on a circuit board, so that the edge portion of the conductor F is situated on the contact sections 24A of the terminals 20. Then, the pressuring member 40 is rotated to the closed position for applying a pressure to the flat conductor F against the contact sections 24A, so that the flat conductor F is electrically connected to the connector.

In the connector according to the embodiment of the invention, the holding grooves 13 of the holding section 11 of the housing open upward, so that the open area is formed above the upper faces of the holding sections 11 over the arrangement range of the terminals 20. Accordingly, the sheet member 50 is disposed in the open area. As shown in FIGS. 4(A) and 4(B), the sheet member 50 is formed of, for example, an insulating sheet having flexibility through stretching and fabricating an electrically insulating material such as a synthetic resin.

Figure 3:
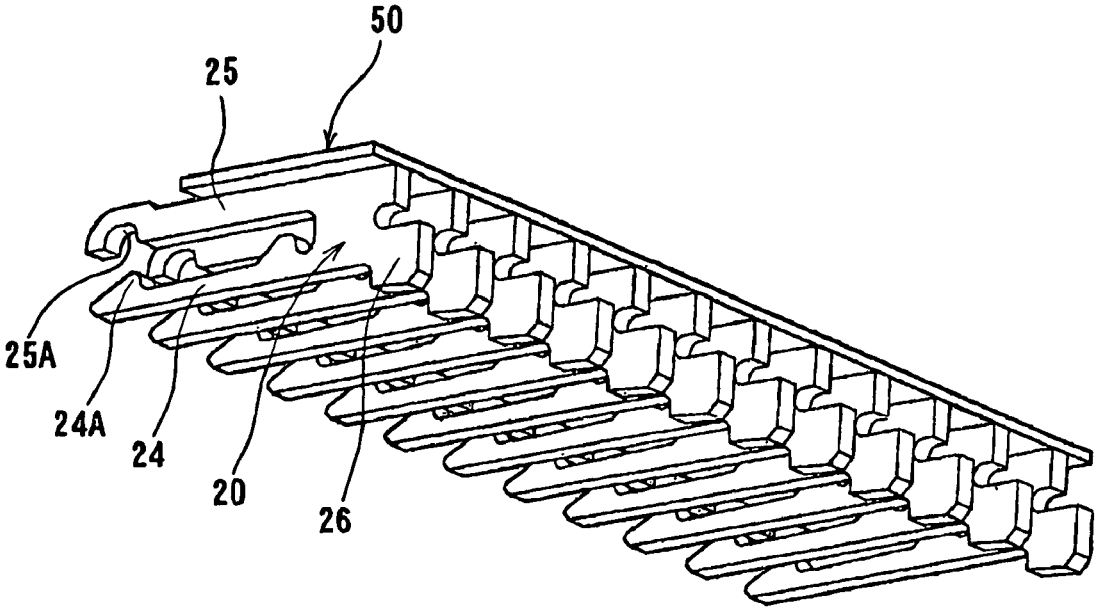
FIG. 3 is a perspective view showing the terminals and a sheet member viewed from below.

As shown in FIG. 4(A) and FIG. 3, the sheet member 50 contacts with the upper faces of the holding sections 11 of the housing 10, or the upper edges of the upper held sections 23 of the terminals 20 inserted in the holding grooves 13. The sheet member 50 is adhered with an adhesive to the upper faces of the holding sections 11 and held thereto. In place of the insulating sheet, a metal sheet 51 such as a metal foil may be used as the sheet member 50. The sheet metal 51 is also extremely thin, and has flexibility similarly to the insulating sheet.

Figure 5:
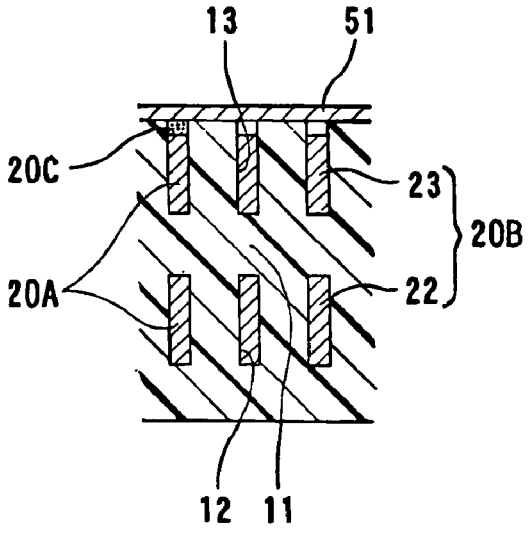
FIGS. 5(A) and 5(B) are views showing a modified example of the connector corresponding to FIGS. 4(A) and 4(B)
Figure 5:
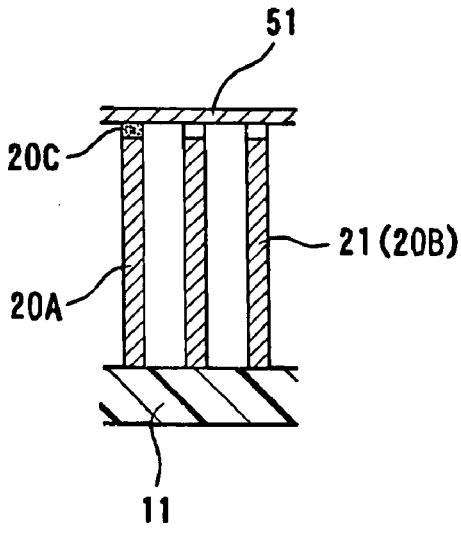

As shown in FIG. 5, the terminals 20 arranged at the both ends in the arrangement direction function as ground terminals 20A, and the terminals 20 other than the ground terminals 20A arranged between the ground terminals 20B function as signal terminals 20B (only one ground terminal 20A at the left side is shown in FIGS. 5(A) and 5(B)). An upper edge of the held section 23 of the signal terminal 20B is embedded in the holding groove 20C, so that the sheet metal 51 does not contact with the signal terminals 20A as shown in FIGS. 5(A) and 5(B). The sheet metal 51 is electrically connected to the ground terminals 20B disposed at the both ends with solder 20C or the like. The metal sheet 51 may contact with the reinforcing metal parts 30 together with the ground terminals 20A, thereby being held by the reinforcing metal parts 30. Alternatively, when there is no ground terminal provided, the metal sheet 51 may be held solely by the reinforcing metal parts 30.

Figure 6:
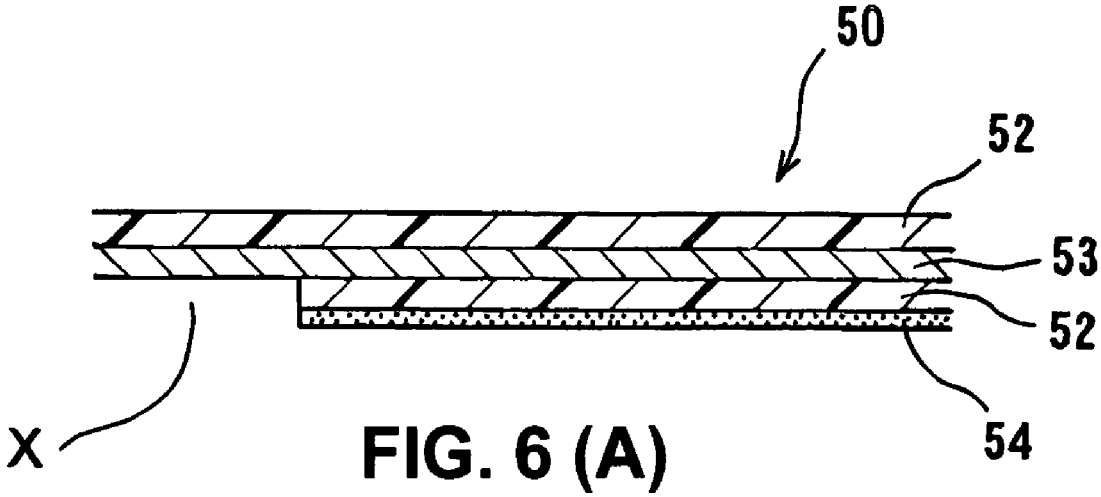
FIGS. 6(A), 6(B), and 6(C) are sectional views showing modified examples of a composite structure of the sheet member.
Figure 6:
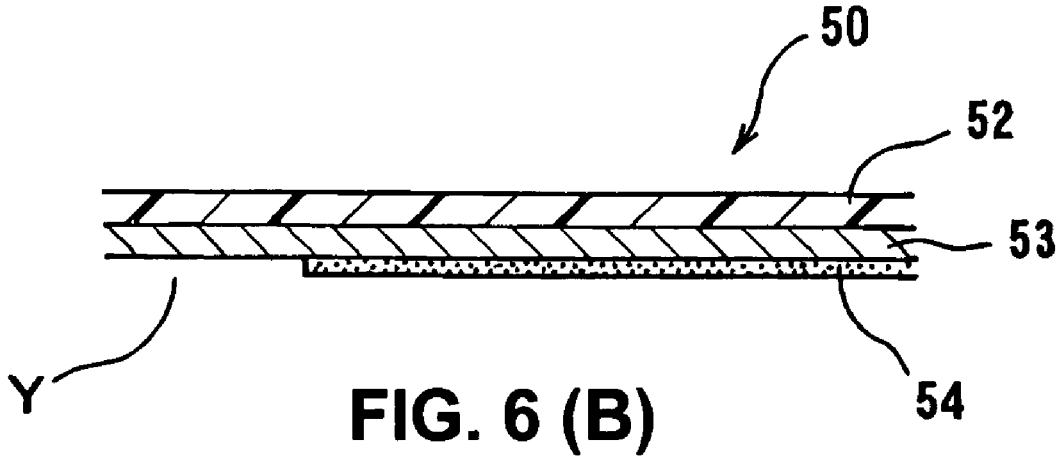
Figure 6:
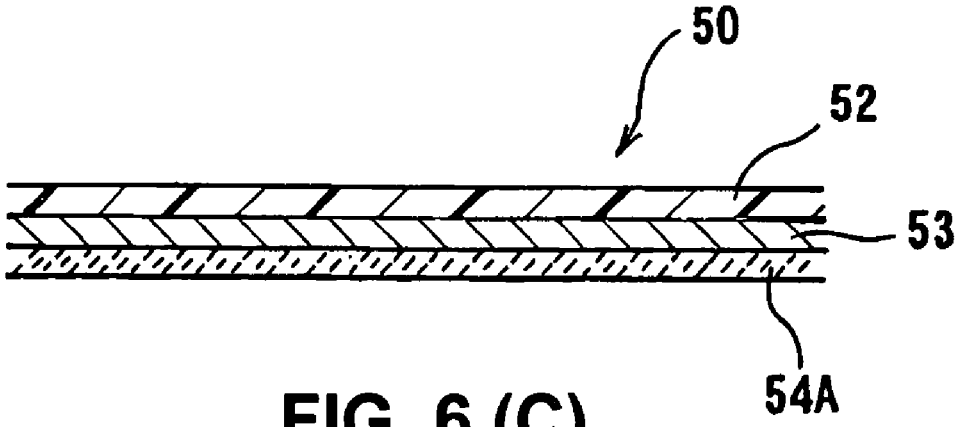

As shown in FIGS. 6(A) to 6(C), the sheet member 50 may be formed of a composite sheet comprising an insulating layer 52 and a metal layer 53, thereby having functions of both an insulating sheet and a metal sheet. In FIG. 6(A), the insulating layers 52 are formed on both sides of the metal layer 52, and the insulating layer 52 at a lower side has an adhesive layer 54 on a surface thereof. The sheet member 50 has an exposed area X at a position corresponding to the ground terminal 20B and the reinforcing metal parts 30, where the insulating layer 52 and the adhesive layer 54 are not provided.

When the connector is used, the sheet member 50 is attached to the open area of the housing 10 and the terminals 20 with the adhesive layer 54, and the exposed portion X is soldered to the ground terminal 20B and the reinforcing metal parts 30. A release sheet is attached to the adhesive layer 54, so that the release sheet is peeled off when the sheet member 50 is attached. The metal layer 53 may be formed of a copper foil, and the insulating layer 52 may be formed of a polyimide.

As shown in FIG. 6(B), the insulating layer 52 may be provided only on one surface of the metal layer 53. In FIG. 6(B), the insulating layer 52 formed of a glass epoxy layer is attached to the upper surface of the metal layer 53 formed of a copper foil, and the adhesive layer 54 is formed on the lower surface of the metal layer 53. An exposed area Y without the adhesive layer 54 is formed at a position corresponding to the ground terminal 20B and the reinforcing metal parts 30.

As shown in FIG. 6(C), an adhesive layer 54A may be formed of an anisotropic conductive adhesive. The anisotropic conductive adhesive contains conductive fine particles. When a pressure is applied on both faces of the adhesive layer 54A through an upper member and a lower member, only a portion received the pressure becomes conductive, so that the upper member and the lower member connect electrically. In the sheet member 50 shown in FIG. 6(C), the adhesive layer 54A does not need to have a portion corresponding to the ground terminal 20B and the reinforcing metal parts 30, and can be attached over a whole surface. When the connector is used, the sheet member 50 is pressed against the ground terminal 20B and reinforcing metal parts 30, so that the sheet member 50 is electrically connected to the ground terminal 20B and the reinforcing metal parts 30.

Figure 7:
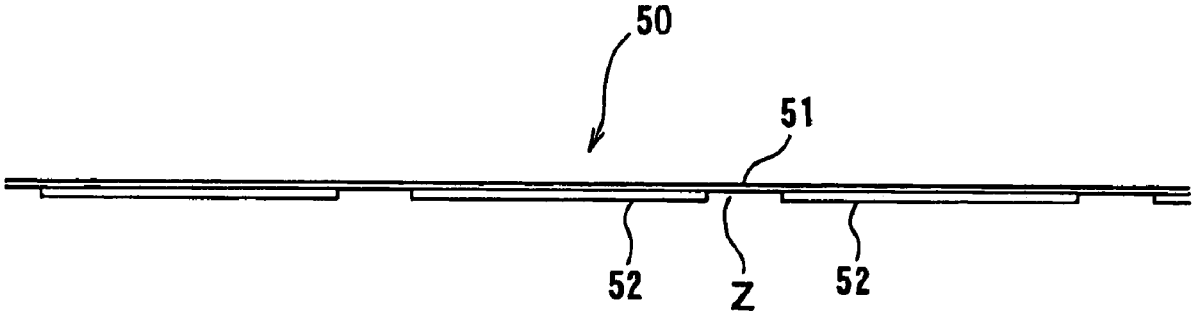
FIG. 7 is a view showing a further example of the composite structure of the sheet member.

As shown in FIG. 7, the insulating layers 52 may be disposed on the metal sheet 51 only at necessary positions. The sheet member 50 is cut at an exposed area Z where the insulating layer 52 is not provided, and attached to the connector, so that the exposed area Z is electrically connected to the ground terminal 20B and the reinforcing metal parts 30.

The exposed area Z may be provided in any position. For example, the ground terminals 20B and the signal terminals 20A may be arranged alternately, and the exposed areas Z may be disposed at corresponding positions for electrical connection. The insulating layer 52 is a part separated from the housing 10, so that the insulating layer 52 can be provided at the metal sheet 51 by molding.

Figure 8:
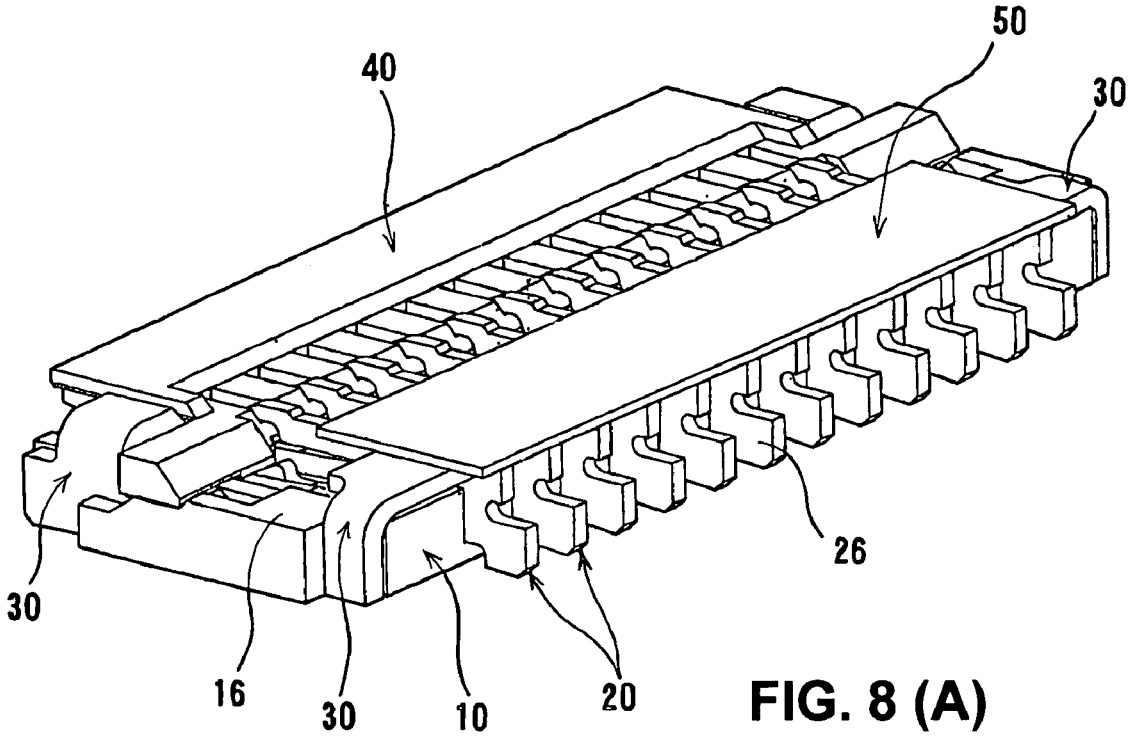
Figure 8:
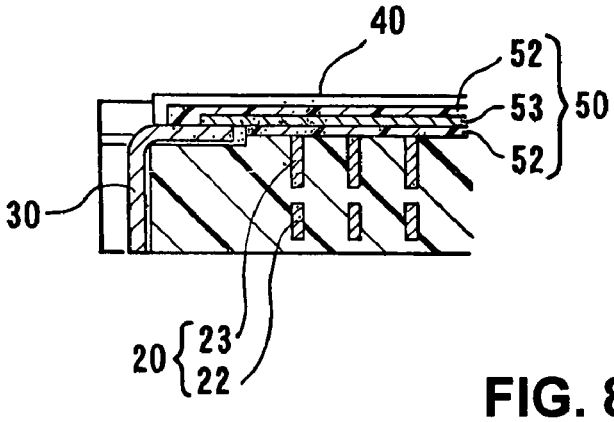

Alternatively, as shown in FIGS. 8(A) and 8(B), the insulating layer 52 may be connected to the reinforcing metal parts 30. As shown in FIG. 8(B), the sheet member 50 has the insulating layer 52 on the upper and lower surfaces of the metal layer 53. The insulating layer 52 on the lower surface is not provided at a left edge, so that the metal layer 53 is exposed. The sheet member 50 is connected to the upper surfaces of the reinforcing metal parts 30 by soldering at the exposed area.

In the invention, the material of the metal sheet or the metal layer and the material of the insulating sheet or the insulating layer are not limited to the embodiments, and may be changed to other materials. For example, aluminum can be used as the metal material, and epoxy or LCP (liquid crystalline polymer) can be used as the insulating material.

As described above, according to the invention, by using an extremely thin sheet member, a low profile connector can be provided, and the terminals are protected with the insulating sheet or the insulating layer. The connector is shielded and connected to ground by the metal sheet or the metal layer.

The disclosure of Japanese Patent Application No. 2006-172070, filed on Jun. 22, 2006, is incorporated in the application.

While the invention has been explained with reference to the specific embodiments of the invention, the explanation is illustrative and the invention is limited only by the appended claims.

What is claimed is:

1. An electrical connector to be arranged on a circuit board, comprising:

a housing made of an insulating material;

a holding section disposed in the housing, said holding section having an open area opening upward;

a terminal arranged in the holding section, said terminal including a connecting section exposed outside the housing for connecting to the circuit board, said terminal further including a signal terminal and a grounding member both held in the housing; and a sheet member situated over the holding section for covering at least a part of the open area, said sheet member including a sheet metal disposed away from the signal terminal and contacting with the grounding member.

2. The electrical connector according to claim 1, wherein said sheet member includes a composite sheet formed of an insulating layer and a metal layer, said insulating layer facing the terminal.

3. The electrical connector according to claim 1, wherein said sheet member includes a composite sheet formed of a first insulating layer, a second insulating layer, and a metal layer sandwiched between the first insulating layer and the second insulating layer.

4. The electrical connector according to claim 1, wherein said housing include a receiving section for receiving one end of a flat conductor.

5. The electrical connector according to claim 1, further comprising a pressuring member supported on at least one of the terminal and the housing to be freely rotatable between an open position and a closed position so that the pressuring member presses the flat conductor against the contacting section at the closed position.

6. The electrical connector according to claim 5, wherein said holding section is disposed outside a rotational movement range of the pressuring member.

7. The electrical connector according to claim 1, wherein said sheet member is arranged to cover the signal terminal and the grounding member in the open area.

8. The electrical connector according to claim 1, wherein said grounding member includes a reinforcing metal part attached to the housing.

* * * * *